US006212894B1

(12) United States Patent
Brown et al.

(10) Patent No.: US 6,212,894 B1
(45) Date of Patent: Apr. 10, 2001

(54) MICROPROCESSOR CONTROL FOR A HEAT PUMP WATER HEATER

(75) Inventors: Robert R. Brown, Markle; Christopher C. Mann, Ossian; R. Todd Zeplin, Uniondale, all of IN (US)

(73) Assignee: Waterfurnace International Inc.

( * ) Notice: Subject to any disclaimer, the term of this patent is extended or adjusted under 35 U.S.C. 154(b) by 0 days.

(21) Appl. No.: 08/827,301

(22) Filed: Mar. 28, 1997

(Under 37 CFR 1.47)

Related U.S. Application Data

(60) Provisional application No. 60/014,417, filed on Mar. 29, 1996.

(51) Int. Cl.[7] ..... F25B 30/00

(52) U.S. Cl. ..... 62/180; 62/127; 62/238.6; 62/230; 237/2 B; 236/20 R; 236/25 R

(58) Field of Search ..... 62/238.7, 238.6, 62/230, 126, 127, 180, 177; 237/2 B; 236/20 R, 21 R, 21 B, 25 R

(56) References Cited

U.S. PATENT DOCUMENTS

| | | | | |
|---|---|---|---|---|
| 4,333,002 | | 6/1982 | Kozak | 219/321 |
| 4,481,788 | | 11/1984 | Yoshino | 62/181 |
| 4,507,936 | | 4/1985 | Yoshino | 62/235.1 |
| 4,540,874 | | 9/1985 | Shaffer, Jr. et al. | 219/279 |
| 4,543,468 | | 9/1985 | Shaffer, Jr. et al. | 219/279 |
| 4,558,818 | * | 12/1985 | Harnish | 62/238.6 X |
| 4,592,206 | | 6/1986 | Yamazaki et al. | 62/160 |
| 4,638,147 | | 1/1987 | Dytch et al. | 219/308 |
| 4,868,370 | | 9/1989 | Kroon | 219/295 |
| 4,970,373 | | 11/1990 | Lutz et al. | 219/497 |
| 5,023,432 | | 6/1991 | Boykin et al. | 219/497 |
| 5,095,715 | * | 3/1992 | Dudley | 62/230 X |
| 5,161,386 | | 11/1992 | Higuchi | 62/160 |
| 5,255,338 | | 10/1993 | Robinson, Jr. et al. | 392/451 |
| 5,269,153 | | 12/1993 | Cawley | 62/180 |
| 5,367,602 | * | 11/1994 | Stewart | 237/2 B X |
| 5,471,851 | * | 12/1995 | Zakryk | 62/238.6 |

FOREIGN PATENT DOCUMENTS 02093220 4/1990 (JP) .

* cited by examiner

*Primary Examiner*—Harry B. Tanner
(74) *Attorney, Agent, or Firm*—Baker & Daniels

(57) ABSTRACT

A microprocessor based control system monitors and controls a heat pump water heater system and interfaces the water heating system with an external centralized control system. The microprocessor control system includes sensors, safety switches, device interface relays, user interface devices and precanned software to provide versatile monitoring and control over a heat pump type water heating system. The system generally involves a typical heat pump coupled with a domestic water heater, hot water retention tank or other body of water. The control system provides operational control over the heat pump to maintain the hot water stored in the domestic water heater in a predetermined setpoint and controls the use of electric resistance heating elements in the domestic water heater for added heating capacity for quick heat recovery type operation. The control system receives a centralized signal typically from a utility company to disable heat pump water heating operation during peak demand time periods. Control logic is provided to carry out effective liming parameter control, high evaporator temperature control, and defrost/anti-freeze protection control.

58 Claims, 5 Drawing Sheets

MICROPROCESSOR CONTROL FOR A HEAT PUMP WATER HEATER

CROSS-REFERENCE TO RELATED APPLICATION

This application claims the benefit under Title 35, U.S.C. § 119(e) of U.S. Provisional Patent Application Ser. No. 60/014,417, entitled MICROPROCESSOR CONTROL FOR A HEAT PUMP WATER HEATER, filed on Mar. 29, 1996.

BACKGROUND OF THE INVENTION

The invention generally relates to electronic control systems used in controlling liquid heating apparatus for raising the temperature of connected bodies of water. More particularly, the present invention relates to a control system which controls a heat pump which is coupled in heat exchange relationship to a domestic water heater, or other body of water to be heated such as a spa. Such a heat pump may be self-contained with a hot water retention tank provided therein and may be either an air-to-water type unit, a water-to-water type unit or a direct exchange (DX)-to-water type unit.

It is known to replace or augment conventional electric resistance water heaters with heat pump water heaters as a more efficient means of producing domestic hot water. One prior art method of controlling such heat pump water heaters has been to use two-position bimetallic type thermostats which are generally provided in domestic water heaters as the primary operating control. An example of such a prior art heat pump water heater control circuit may be found at U.S. Pat. No. 5,255,338 (Robinson, Jr. et al). One advantage of this type of arrangement is that the hot water thermostat is located directly in the hot water tank.

A disadvantage associated with the above described method is that two-position bimetallic type thermostats are not as versatile as full range type sensors, such as thermistors, and are not as effective when used with microprocessor type controls. Another disadvantage is that tying into the water heater thermostat and control wiring often results in voiding UL or other industry certifications. Other prior art systems have placed sensors directly in the hot water tank, which results in the disadvantage of added retrofit labor and material costs and, again, the possibility of voiding certifications.

While the comparison of energy costs between heat pump type water heaters versus electric resistance type water heaters favors the use of the heat pump, one detraction from the use of heat pump type water heaters is the issue of quick heat recovery. In keeping the costs of heat pump type water heaters comparable with the costs of electric resistance type water heaters, manufacturers have tried to minimize the size of the compressor used in heat pump type water heaters. An unfortunate result of this is the reduced heating capacity of the heat pump water heater unit. While a typical electric resistance type water heater will deliver 16,000 BTU's per hour of heating capacity, a typical heat pump type water heater has a much reduced heating capacity of 7,000 BTU's per hour. Accordingly, when a large demand for hot water consumes the hot water stored in the hot water retention tank, the electric resistance type water heater is able to more rapidly heat the replacement cold water than a typical heat pump type water heater.

For consumer satisfaction, a quick heat recovery rate is essential. For this reason heat pump type water heaters are most often used in conjunction with conventional electrical resistance type water heaters. The electric resistance heating elements are generally used to compliment the heat pump water heating capacity during periods of large demand. Another problem typically associated with heat pump water heaters is that of liming, which effectively reduces the capacity of the unit and may eventually lead to compressor damage. A prior art method of preventing compressor damage due to liming was to include a high pressure switch to terminate compressor operation upon excessive pressure being exhibited in the heat pump system. A draw back associated with this is that the compressor is shut down, often prematurely, with no advance warning and a service call is required to place the unit in an operating condition.

Another condition associated with heat pump operation is that of high evaporator temperature, which corresponds to high suction pressure. Generally, the suction side high pressure limit for a heat pump water heater type compressor is 90 PSIG, this corresponds to an evaporator refrigerant discharge temperature of 62°. In the case of an earth ground loop system operating under summer conditions, the loop temperature will often be in the range of 80°–100° F. or above. This results in elevating the evaporator refrigerant discharge temperature above 62° F. and tripping the high suction pressure limit switch. Prior art heat pump water heaters coupled to a ground loop system simply lock out compressor operation based upon a high pressure limit switch located on the suction side of the compressor. In the case of air-to-water type heat pump units, freeze protection on the evaporator coil is of prime importance. Prior art heat pump water heaters utilize a two-position bimetallic type thermostat which locks out compressor operation upon experiencing a freeze condition at the intake of the evaporator coil. To place the heat pump unit in a condition for operation, a service call was necessary or at least a resetting of the freeze-stat by maintenance personnel.

SUMMARY OF THE INVENTION

In particular, the invention relates to a microprocessor based control circuit which utilizes resident operational programs, variable signal inputs and contact closure type inputs and outputs to monitor and control heat pump water heater apparatus. The present invention microprocessor based control system is used for monitoring and controlling heat pump based water heating systems and for interfacing the water heating system with a centralized control source, such as an energy provider initiated enabling/disabling signal. In general, a conventional non-reversing heat pump is coupled to a conventional electric resistance type domestic water heater or hot water retention tank for the purpose of elevating the temperature of the water stored in such water heater or tank for providing domestic hot water. In the alternative, the heat pump may be coupled to any other body of water to be heated, such as a hot tub, spa or pool. A stand alone heat pump water heater having an integral hot water retention tank may be used and air-to-water, water-to-water, and DX-to-water type heat pumps are fully contemplated by the present invention.

Rather than utilizing the conventional thermostatic controls included with a domestic water heater to operate the heat pump, a microprocessor based control system is utilized for enhanced system operation and operator interface. A hot water temperature sensor, such as a thermistor, is placed in the hot water circuit and monitors hot water. Typically, the heat pump condenser is coupled with the domestic water heater so as to form a hot water circuit with a dedicated hot water pump interposed therein. Operational programs are downloaded and stored in memory associated with the microprocessor and include such routines as demand sampling, periodic sampling, on peak setback, quick heat recovery mode, liming parameter control, high evaporator temperature control, fault retry, loop pump slaving, testing and diagnostics.

To implement demand sampling, temperature sensors are placed in the cold water supply entering the domestic water heater and in the domestic hot water supply exiting the domestic water heater. In the event a decrease in temperature is sensed in the cold water supply and an increase in temperature is sensed in the domestic hot water supply, the control system energizes the dedicated hot water pump so as to cause hot water to circulate from the domestic water heater into the condenser and back into the domestic water heater.

In this manner the temperature of the hot water stored in the domestic water heater is sampled by the microprocessor control system and in the event of a call for heating, the microprocessor cycles the heat pump. If there is no demand for hot water, as sensed by the cold water supply sensor and the domestic hot water supply sensor, the microprocessor will cycle the hot water supply pump and sample the hot water temperature at preset periodic intervals, say every other hour.

In the alternative, the microprocessor control system may utilize a preset periodic sampling routine which energizes the dedicated hot water pump and samples the hot water temperature therein according to preset periodic intervals. For instance, every fifteen minutes the pump will be turned on and the temperature sampled to determine if the temperature of the water stored in the hot water retention tank has dropped below a preset hot water setpoint. A disadvantage associated with this alternative is that at a minimum the hot water pump is required to run at the beginning of each periodic sampling period just for determining demand use.

Another feature incorporated in the microprocessor control system of the present invention is on peak setback control. This permits an external signal, such as that generated by a centrally located energy source such as a utility, to disable all hot water heating operation during peak demand periods, i.e. those periods when overall energy use is high and the cost of energy is at a peak. Such a signal may be communicated via radio frequency or other communication medium and is generally recognized by the microprocessor controller in the form of a contact closure grounded signal. An override switch may be provided at the heat pump water heater unit to override the on peak disabling signal and to independently enable water heating operation.

Another feature associated with the microprocessor control system of the present invention is quick heat recovery mode, wherein electric resistance heating elements of a conventional domestic hot water heater may be utilized to supplement the heating capacity of the heat pump water heater. Upon a substantial demand for hot water, it is extremely important for a water heating system to provide quick heat recovery for additional hot water usage to adequately satisfy the needs of the end users.

The quick recovery mode of operation may be disabled by a centrally initiated control signal in a manner similar to that described above relating to the on peak setback feature. The use of the electric resistance heating elements to supplement the heating capacity of the heat pump water heater may be disabled by a central control signal, such as generated by a utility company for various purposes. Again, the signal may be communicated via radio or other communication means and is generally recognized by the microprocessor controller in the form of a contact closure grounded signal.

As an example, with the hot water temperature more than say 50° F. below setpoint, i.e. 85° F. with a setpoint of 135° F., the quick heat recovery mode logic allows the electric resistance heating elements of the domestic water heater to cycle on until the hot water temperature reaches say 25° F. below setpoint, i.e. 110° F., for thirty continuous seconds. In this manner the effective water heating capacity of the system is effectively doubled so as to increase comfort during high hot water draw peak periods, such as multiple showers etc. The microprocessor control system is provided with random start logic so that after the on peak setback signal has changed states so as to permit heat pump water heater operation, the heat pump water heater units will be randomly started over a preset period of time to prevent excessive instantaneous energy demand during power up.

Another feature associated with the microprocessor control system of the present invention is condenser liming parameter control logic. When liming occurs the heat exchanger capacity decreases, effectively making the heat exchanger smaller and smaller such that eventually the compressor cannot maintain setpoint due to insufficient heat transfer. As mineral buildup increases at the condenser, head pressure will be proportionately elevated as the heat pump unit continues to maintain the preset temperature of delivery water. If left unchecked, premature compressor wear and damage will result. Rather than simply using a high pressure lock-out switch, the microprocessor control system of the present invention prevents premature compressor lock-outs and service calls by adjusting the hot water setpoint and implementing a series of retry logic routines.

In the event a high pressure situation occurs, a high pressure switch trips and signals a fault condition to the microprocessor. Control logic within the microprocessor discontinues heat pump unit operation, reduces the hot water setpoint by say 5° F. and initiates a five minute delay period. At the end of this delay period the control system restarts the water heating operation. If the high pressure switch does not trip, then the unit will continue to operate at the reduced setpoint and the microprocessor control system will begin flashing an LED service light which will alert the service technician at the next scheduled servicing of the unit that a liming condition exists. If after the delay period the high pressure switch again trips and signals a fault, then the control logic will again discontinue heat pump operation, reduce the setpoint an additional say 5° F. and initiate another say five minute delay period. If the fault condition persists after a given number of tries and the hot water setpoint is reduced to a preset minimum, then the water heating unit is locked out and an audible alarm is sounded.

Another feature included in the microprocessor control system is high evaporator temperature logic which disables the heat pump when loop temperature becomes excessive, this feature is primarily for use with water-to-water ground loop systems. In the case of an earth coupled ground loop system, particularly in southern regions during the summer, the heat source loop water may reach temperatures above 90° F. In such extreme conditions the suction pressure will be above the typical 90 PSIG compressor limit and damage to the compressor may occur.

Another feature of the microprocessor control system involves providing a loop pump slaving signal between multiple heat pump water heater control boards whereby a remote loop pump may be energized according to a slaving signal. If any one of the multiple heat pump water heater control boards calls for loop pump operation then the remote loop pump will be energized. An additional feature incorporated in the microprocessor control system relates to fault retry logic. The fault retry logic implements a retry routine whereby selected faults reported to the microprocessor are retried at least once before heat pump water heater operation is locked out. In addition, a 30 second fault recognition period is required before a fault signal will be recognized as a fault. This retry feature serves to reduce unnecessary nuisance service calls and to prevent unnecessary heat pump water heater operation shutdown.

An additional feature of the microprocessor control system relates to a test mode routine which through an operator interface is selectable by service personnel to achieve shortened time delays for faster diagnostics. In addition, a diagnostic routine is provided whereby all inputs, outputs, thermistor status, and dynamic sensor modes (real time display of sensor input faults) can be displayed via one or more LEDs for fast and simple control board diagnostics. A "soft" reset may be implemented by using a reset switch after fault lockout, whereby all applicable fault LED indicators will remain lit for easy troubleshooting by service personnel. Upon initiating a "hard" reset, such as by removing power, all fault indication is cleared.

The microprocessor control system of the present invention utilizes a temperature sensor which is located in the suction line between the evaporator and the compressor. In the event the suction line temperature sensor senses an entering temperature of say 58° F., which directly relates to the 90 PSIG suction pressure limit, the control system disengages the heat source loop pump. In this manner the heat source is drawn into the evaporator section in a segmented rather than continuous fashion, thereby effectively dropping the average loop water temperature to say 85° rather than the actual heat source temperature of say 97°. By dropping the average loop water temperature by say 12° F., the microprocessor control system allows effective compressor operation and avoids unnecessary lock-out. The heat source loop pump is reactivated when the temperature of the fluid entering the compressor has dropped to say 48° F.

In the case of air-to-water type heat pump units, the evaporator air coil may frost up or freeze if the coil gets below the freezing point of water. A freeze protection sensor is placed on the entering side of the evaporator air coil and provides a signal representative of that temperature to the microprocessor controller. Upon sensing an air coil condition of say 28° F., a fault condition is reported and the electric heating resistance elements are energized to satisfy any call for hot water heating. In addition, a freeze protection LED is caused to flash indicating a frost or low ambient condition and the operating mode transitions to emergency mode. Rather than completely shutting the unit down, retry logic as described above is utilized for a freeze fault condition. The time interval of the delay period may be extended based upon the temperature sensed and the unit may or may not be locked out after a given number of consecutive faults. If the temperature does not go above say 35° F., then the heat pump unit stays in the emergency mode allowing the electric resistance heat to satisfy any demand for hot water and the low ambient freeze protection LED continues to flash.

The microprocessor control system accepts an optional aquastat type control signal to directly control or augment the control of the water heating system. This is particularly useful when utilizing the heat pump water heating system in conjunction with a pool or hot tub type spa.

The microprocessor control system of the present invention includes numerous safety controls, high pressure switch, low pressure switch, freeze protection, audible alarms, LED's for diagnostic and fault condition indication and short cycle protection. In addition, testing, fault retry, diagnostics, startup, and random start routines are provided for enhanced system operation. A multiple pin dip switch is utilized for direct user interface to permit field selectable options such as service test mode, air/liquid/DX based unit selection, time sampling/demand sampling control selection, freeze protection setting, hot water temperature setting selection, and diagnostics routine selection. All of the above described features are advantages of the microprocessor control system of the present invention over prior art heat pump water heating apparatus.

In one embodiment the invention provides an electronic control system for controlling a heat pump water heater including a compressor, an evaporator, and a condenser coupled with a hot water retention tank to form a hot water circuit. The hot water retention tank includes means for receiving water from a supply and provides domestic hot water. The heat pump water heater control system consists of the following components. A first sensor for sensing the temperature of water in the hot water circuit and for generating a first output signal representative of such temperature. A second sensor for sensing the temperature of the cold water supply at the inlet of the hot water retention tank and for generating a second output signal representative of such temperature. A third sensor for sensing the temperature of the domestic hot water at the output of the hot water retention tank and for generating a third output signal representative of such temperature. A pump for circulating water from the hot water retention tank, through the condenser and back to the hot water retention tank. A microprocessor receives the first, second and third sensor output signals and, upon detecting a drop in the temperature of the water at the receiving means and a rise in the temperature of the water at the discharge means energizes the pump and samples the hot water circuit temperature. The microprocessor cycles the heat pump water heater to maintain a predefined hot water setpoint.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
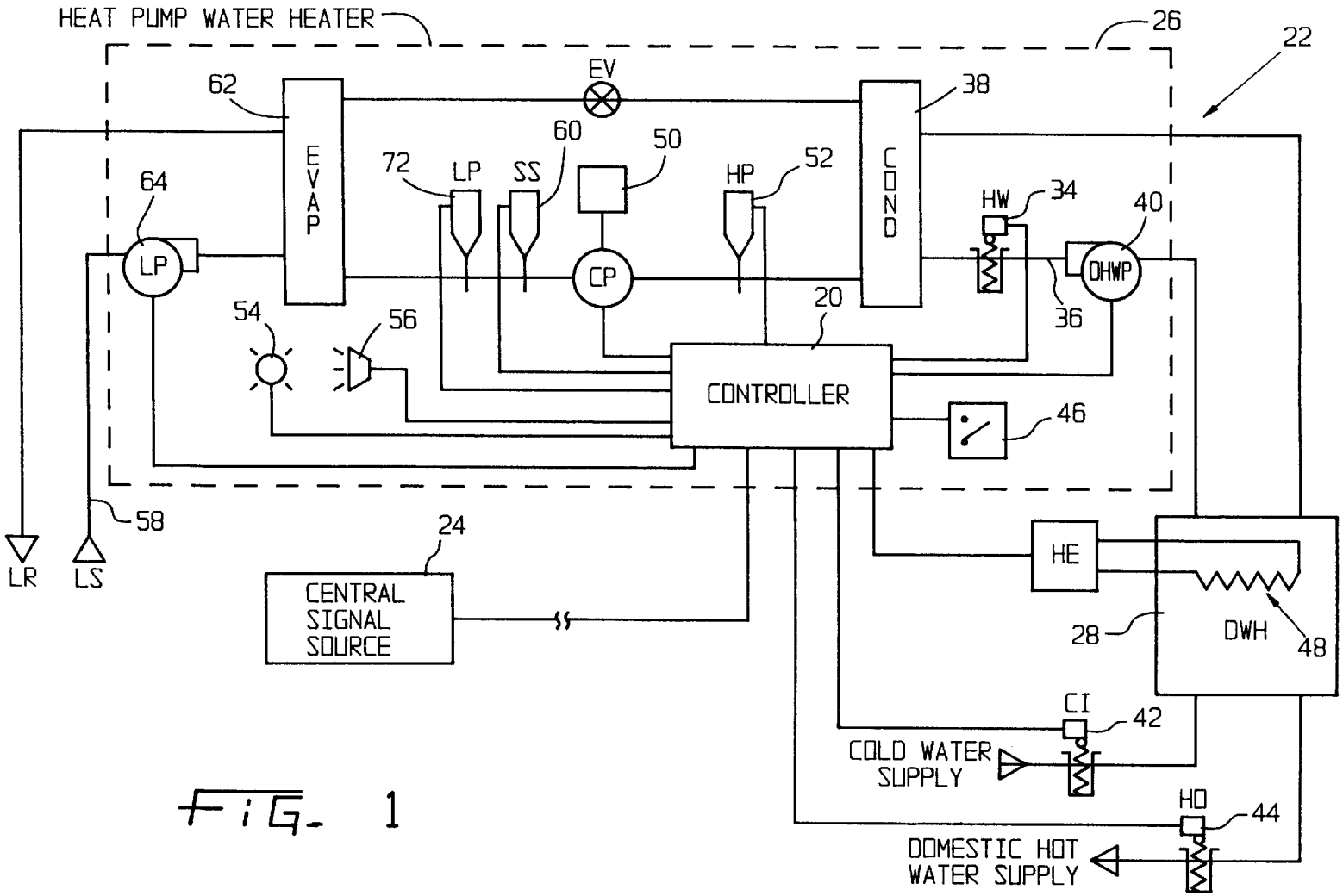
FIG. 1 is a schematic diagram of the heat pump water heating system of the present invention utilizing a water-to-water heat pump coupled to a conventional electric resistance domestic water heater.
Figure 2:
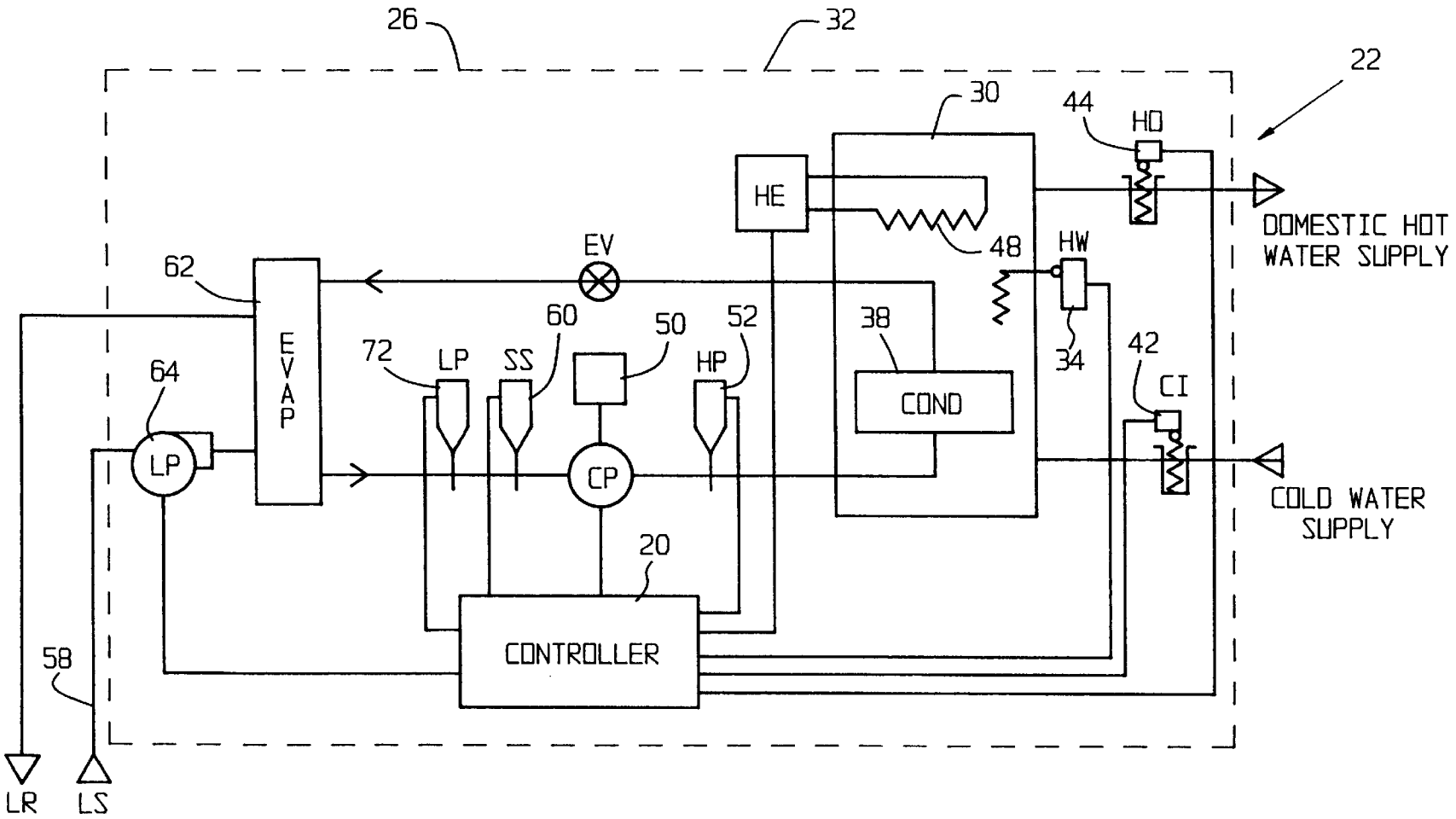
FIG. 2 is a schematic diagram of the heat pump water heating system of the present invention utilizing a water-to-water heat pump with an integral hot water retention tank.
Figure 3A:
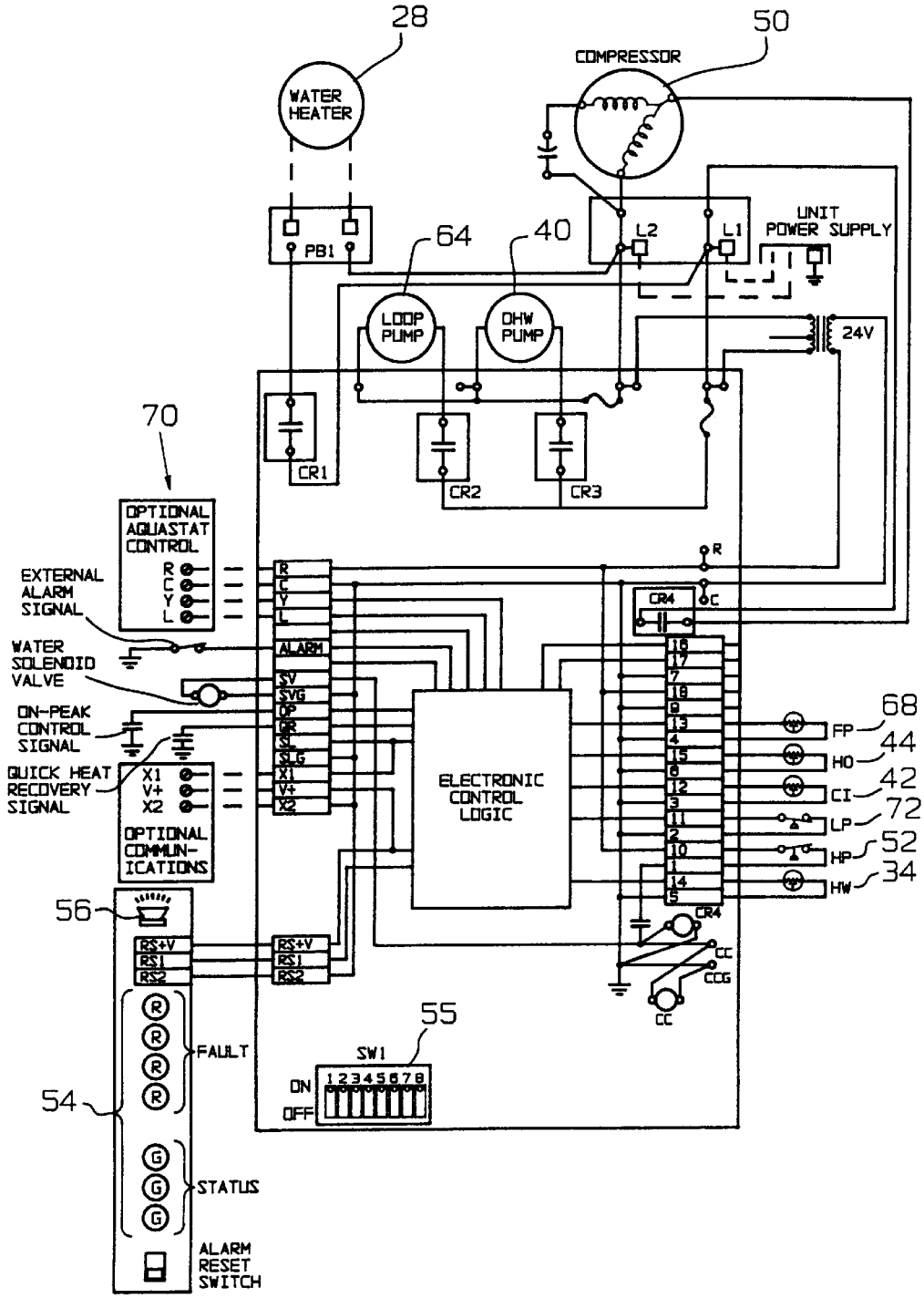
FIG. 3A is a schematic diagram of the microprocessor based electronic control system of the heat pump water heating system of FIG. 1.
Figure 3B:
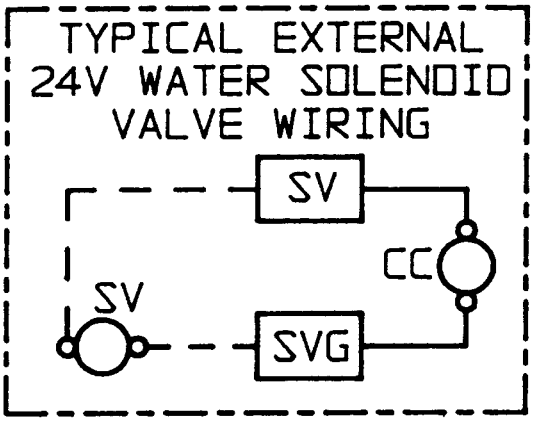
FIG. 3B is a schematic diagram showing a typical optional external solenoid valve which may be operated by the control system of FIG. 3A.

In FIG. 1 the present invention is shown having microprocessor based control system 20, illustrated in FIG. 3A, for monitoring and controlling heat pump based water heating system 22 and for interfacing water heating system 22 with centralized control source 24, such as energy provider initiated enabling/disabling signals. Conventional non-reversing heat pump 26 is coupled to electric resistance type domestic water heater 28 or integral hot water retention tank 30, as shown in FIG. 2, for elevating the temperature of water stored in water heater 28 or tank 30, typically used for providing domestic hot water. In the alternative, heat pump 26 may be coupled to any other body of water to be heated, such as a hot tub, spa or pool. FIG. 2 illustrates stand alone heat pump water heater 32 having integral hot water retention tank 30.

Rather than utilizing thermostatic controls associated with conventional domestic water heater 28 to operate heat pump water heater system 22, microprocessor based controller 20 is utilized for enhanced system operation and interface. Selection of temperature setpoint may be accomplished via a DIP switch on controller 20. Hot water temperature sensor 34, such as a thermistor, is placed in hot water circuit 36 to monitor hot water circuit temperature and generates a signal which is input to controller 20. Heat pump condenser 38 is coupled with domestic water heater 28 so as to form hot water circuit 36 with dedicated hot water pump 40 interposed therein. Operational programs are downloaded into controller 20 and include such routines as demand sampling, periodic sampling, on peak setback, quick heat recovery mode, liming parameter control, and high evaporator temperature control. An external thermostat may be utilized via controller 20 to initiate compressor/pump/fan operation to satisfy a demand for hot water.

In implementing demand sampling, temperature sensors 42, 44 are respectively placed in the cold water supply entering the domestic water heater and in the domestic hot water supply exiting the domestic water heater. In the event a decrease in temperature is sensed at the cold water supply and an increase in temperature is sensed at the domestic hot water supply, a demand flag transitions to an active state and controller 20 energizes the dedicated hot water pump 40 so as to cause hot water to circulate from domestic water heater 20 into condenser 38 and back into the domestic water heater. In this manner the temperature of the water stored in domestic water heater 28 is sampled by controller 20 and in the event of a call for heating, controller 20 cycles heat pump 26 to maintain setpoint. In the event no hot water demand is sensed by cold water supply sensor 42 and domestic hot water supply sensor 44, controller 20 will sample the temperature of hot water circuit 36 at preset periodic intervals, such as once every other hour.

In the alternative, controller 20 may utilize a preset periodic sampling routine which energizes dedicated hot water pump 40 and samples the hot water circuit temperature at preset periodic intervals. For instance, every fifteen minutes pump 40 will be turned on and the hot water circuit temperature sampled by sensor 34 to determine if the temperature of the water in domestic water heater 28 has dropped below a preset hot water setpoint.

Microprocessor controller 20 stores historical information relating to usage in memory and utilizes trend routines to effectively "learn" demand usage patterns. In this manner controller 20 can predict periods and patterns of heightened hot water demand and, in advance of such periods, raise hot water temperature to a desirable level.

Controller 20 utilizes on peak setback control programming which permits external enabling/disabling signal 24, such as that generated by a centrally located energy source, such as a utility, to disable hot water heating operation during peak demand periods, i.e. when overall energy use is high and the cost of energy is at a peak. Such a signal may be communicated via radio frequency or other means of communication and is generally recognized by controller 20 in the form of a contact closure grounded signal. Override switch 46 may be provided at the heat pump water heater unit to override the on peak disabling signal and to independently enable water heating operation.

Controller 20 also utilizes a quick heat recovery routine, wherein electric resistance heating elements 48 of conventional domestic hot water heater 28 may be utilized to supplement the heating capacity of heat pump water heater 26. This quick heat recovery mode of operation is important when a substantial demand for hot water is experienced. In this manner the overall water heating capacity of water heating system 22 is increased to adequately satisfy the needs of the end users.

The quick heat recovery mode of operation may be disabled by centrally initiated control signal 24 in a manner similar to that described above relating to the on peak setback feature. In addition, quick heat recovery mode may be locally disabled via a DIP switch provided on controller 20. The use of electric resistance heating elements 48 to supplement the heating capacity of heat pump water heater 26 may be disabled by central control signal 24 which may be utilized by a utility company for various purposes. Again, signal 24 may be communicated via radio or other communication means and is generally recognized by controller 20 in the form of a contact closure grounded signal. As an example, with the hot water temperature more than say 50° F. below setpoint (say 135° F.) the quick heat recovery mode logic allows electric resistance heating elements 48 of domestic water heater 28 to become energized until the hot water temperature reaches say 25° F. below setpoint for say thirty continuous seconds. In this manner, the effective water heating capacity of system 22 is effectively doubled to increase comfort during high hot water draw peak periods, such as multiple showers etc. Controller 20 is provided with random start logic so that after the on peak setback signal has changed states so as to permit heat pump water heater operation. Where multiple heat pump water heating systems are enabled/disabled by a single central control signal 24, the heat pump water heater units will be randomly started over a preset period of time to prevent excessive instantaneous energy demand.

Controller 20 also utilizes condenser liming parameter control logic. As mineral buildup increases at condenser 38, head pressure will be proportionately elevated to maintain the temperature of the delivery water. If left unchecked eventually premature compressor wear and resulting damage will result. When liming occurs the heat exchange capacity of heat pump 26 decreases, effectively making the heat exchanger smaller and smaller such that eventually compressor 50 cannot maintain setpoint due to insufficient heat transfer. Rather than simply using a high pressure lock-out switch, controller 20 prevents premature compressor lock-out and service call situations by adjusting the hot water setpoint and implementing a series of retry logic routines.

In the event a high pressure situation occurs, high pressure switch 52 trips and signals a fault condition to controller 20. Control logic associated with controller 20 discontinues the operation of heat pump unit 26, reduces the hot water setpoint by say 5° F. and initiates a five minute delay period. At the end of this delay period controller 20 restarts the water heating operation. If high pressure switch 52 does not trip, then the unit will continue to operate at the reduced setpoint and the controller 20 will begin flashing LED service light 54 to alert a service technician at the next scheduled servicing of unit 22 that a liming condition exists. If high pressure switch 52 again trips and signals a fault, then the control logic will again discontinue heat pump operation, reduce the setpoint an additional say 5° F. and initiate another say five minute delay period. If the fault condition persists after a given number of tries and the hot water setpoint is reduced to a preset minimum, then water heating unit 22 is locked out and audible alarm 56 is sounded.

Figure 4A:
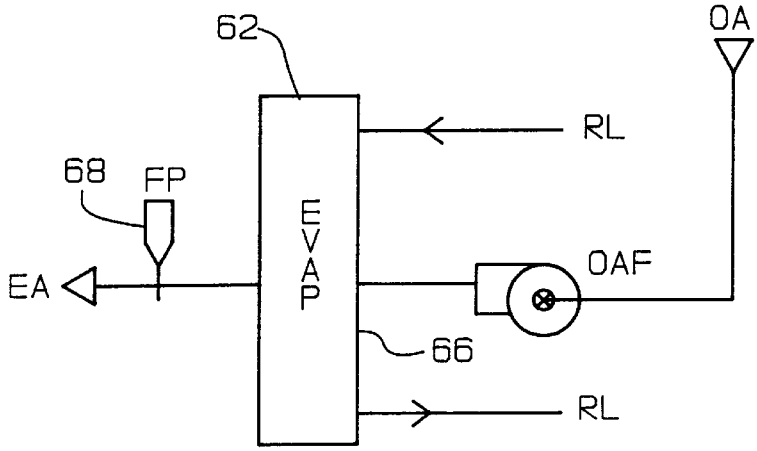
FIG. 4A is a partial schematic diagram showing an alternative evaporator section of the heat pump water heating system of FIG. 1 utilizing an air-to-water type heat pump unit.
Figure 4B:
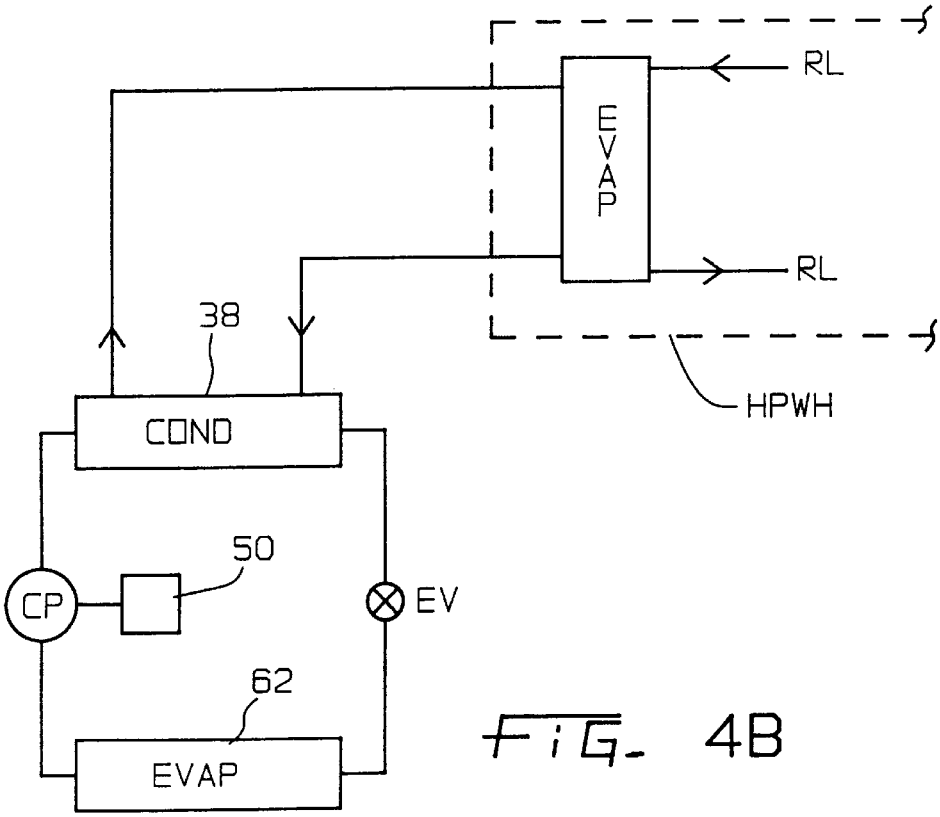
FIG. 4B is a partial schematic of an alternative arrangement of the heat pump water heating system of FIG. 1 utilizing a DX-to-water type heat pump unit.

Controller 20 is also provided with high evaporator temperature logic which disengages heat source loop pump 64 when loop temperature becomes excessive, this feature is primarily for use with water-to-water ground loop systems. In the case of an earth coupled ground loop system, particularly in southern regions during the summer, the temperature of liquid heat source loop 58 may be above 90° F. In such conditions the suction pressure associated with compressor 50 will be above the typical 90 PSIG limit and damage to compressor 50 may occur. Controller 20 receives an input from suction side temperature sensor 60, which is located in the suction line between evaporator 62 and compressor 50. Upon sensing an entering temperature of say 58° F., which directly corresponds to the 90 PSIG suction pressure limit, controller 20 disengages heat source loop pump 64, which may be a remotely located central pump. In the alternative, an air-to-water type heat pump unit, as shown in FIG. 4A, or a DX-to-water type heat pump, as shown in FIG. 4B, may be used in lieu of the water-to-water ground loop type system.

Where there are multiple heat pump water heaters thermodynamically connected to a central heat source loop system, any one controller 20 may energize the central pump. In this manner, the heat source is drawn into evaporator 62 in a segmented rather than continuous fashion, thereby effectively dropping the average loop water temperature to say 85° F. rather than the actual heat source temperature of say 97° F. By dropping the average loop water temperature by say 12° F., continuous and effective compressor operation is achieved. Heat source loop pump 64 is restarted when the temperature in the suction line of compressor 50 has dropped to a reading of say 48° F.

An example of the freeze protection routine operation is as follows. In the case of an air-to-water type heat pump unit, as shown in FIG. 4A, evaporator air coil 66 may frost up or freeze should the coil get below the freezing point of water. Freeze protection sensor 68 is placed on the leaving side of the evaporator air coil and provides a signal representative of that temperature to controller 20. Upon sensing an air coil condition of say 15° F. a fault condition occurs and electric heating resistance elements 48 are energized as needed to satisfy any call for hot water heating. During a freeze condition, LED 54, which may be multiple LEDs, indicates the fault condition, such as by flashing. Controller 20 utilizes retry logic as described above in the event of a freeze fault condition rather than simply shutting the unit down. The time interval of the retry logic delay period may be extended based upon the temperature sensed by sensor 68.

Heat pump unit 26 may or may not be locked out after a given number of consecutive faults. If the sensed temperature does not rise above say 35° F., then heat pump unit 26 stays in the emergency mode, whereby electric resistance heat satisfies any demand for hot water and LED 54 continues to flash. LED 54 flashes in predefined patterns which are distinguishable one from the other depending upon the fault condition(s) that exist(s). In the alternative, multiple LEDs may be used with each having a specific function and such LEDs may flash or remain on (solid) for fault indication.

Controller 20 will accept an optional aquastat type control signal to directly control or augment the control of water heating system 22. This is particularly useful when utilizing the heat pump water heating system in conjunction with a pool or hot tub type spa which may be used in lieu of domestic water heater 28.

The microprocessor based control system, illustrated in FIG. 3A, incorporates numerous safety controls including high pressure switch 52, low pressure switch 72, freeze protection 68, audible alarms 56, LED's 54 for diagnostic and fault condition indication and short cycle protection. In addition, testing, fault retry, diagnostics, startup, and random start routines are provided for enhanced system operation. A multiple pin dip switch SWI, 55, is utilized for direct user interface to permit field selectable options such as service test mode, air/liquid/DX source based unit selection, time sampling/demand sampling control selection, freeze protection setting, hot water temperature setting selection, and diagnostics routine selection.

Microprocessor controller 20 provides a loop pump slaving signal between multiple heat pump water heater control boards whereby a remote loop pump may be energized according to the slaving signal. If any one of the multiple heat pump water heater control boards calls for loop pump operation then the remote loop pump will be energized. An additional feature incorporated in microprocessor controller 20 is fault retry logic. The fault retry logic implements a retry routine whereby selected faults reported to microprocessor 20 are retried at least once before heat pump water heater operation is locked out. In addition, a 30 second fault recognition period is required before a fault signal will be recognized as a fault. This retry feature serves to reduce unnecessary nuisance service calls and prevent unnecessary heat pump water heater operation shutdown.

Microprocessor controller 20 provides a test mode routine which through an operator interface is selectable by service personnel to achieve shortened time delays for faster diagnostics. A diagnostic routine is provided whereby all inputs, outputs, thermistor status, and dynamic sensor modes (real time display of sensor input faults) can be displayed via LEDs for fast and simple control board diagnostics. A "soft" reset may be implemented by using a reset switch after fault lockout, whereby all applicable fault LED indicators will remain lit for easy troubleshooting by service personnel. Upon initiating a "hard" reset, such as by removing power, all fault indication is cleared.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electronic control system for controlling a heat pump water heater including a compressor which includes a suction side, an evaporator, refrigerant for circulating through said evaporator, and a condenser coupled with a hot water retention tank to form a hot water circuit, the hot water retention tank including means for receiving water from a supply source and means for discharging heated water, said control system comprising: first means for sensing the temperature of water in the hot water circuit and generating a first output signal representative of such temperature; second means for sensing the temperature of the hot water at the discharge means of the hot water retention tank and generating a second output signal representative of such temperature; means for circulating water from the hot water retention tank, through the condenser and back to the hot water retention tank; and a controller for receiving said first and second output signals, whereby upon detecting a rise in the temperature of hot water at said discharge means said controller energizes said circulating means, samples said first output signal and cycles the heat pump water heater to maintain a predefined hot water setpoint.

2. The electronic control system of claim 1, further comprising third means for sensing the temperature of water at said receiving means and generating a third output signal representative of such temperature, whereby upon detecting a drop in the temperature of the water receiving means, and a rise in temperature of the heated water at said discharge means, said controller energizes said circulating means, samples said first output signal and cycles the heat pump water heater to maintain a predefined hot water setpoint.

3. The electronic control system of claim 1, wherein said circulating means is a dedicated hot water circulating pump.

4. The electronic control system of claim 1, wherein the hot water retention tank is a domestic water heater having electric resistance heating elements.

5. The electronic control system of claim 1, wherein the hot water retention tank includes electric resistance heating elements, said controller energizes the electric resistance heating elements for added water heating capacity in the event the temperature of the heated water at the discharge means of the hot water retention tank or the temperature of the hot water circuit falls below a predetermined low limit temperature setpoint.

6. The electronic control system of claim 5, wherein a central control signal is capable of enabling/disabling electric resistance heating element operation.

7. The electronic control system of claim 6, wherein said central control signal is initiated by a central energy provider via a radio controlled grounded signal for the purpose of disabling electric resistance heating element operation during peak energy demand periods.

8. The electronic control system of claim 1, wherein a central control signal disables heat pump water heater operation.

9. The electronic control system of claim 8, wherein said central control signal is initiated by a central energy provider during periods of peak energy demand.

10. The electronic control system of claim 9, wherein upon said central control signal permitting heat pump water heater startup, said electronic control system implements a random time delay of between 1 second and 30 minutes during power up.

11. The electronic control system of claim 1 further comprising a low pressure switch disposed in a suction line of the compressor and generating a low pressure output signal representative of a low pressure fault in the event refrigerant pressure falls below a predetermined limit, said controller disabling heat pump water heater and said circulating means operation upon receiving said low pressure output signal.

12. The electronic control system of claim 1 further comprising a high pressure switch disposed in a discharge line of the compressor and generating a high pressure output signal representative of a high pressure fault in the event refrigerant pressure exceeds a predetermined limit, said controller receiving said high pressure output signal.

13. The electronic control system of claim 12, wherein said controller, upon receiving such high pressure output signal, disables heat pump water heater operation for a predetermined period of time and reduces said hot water setpoint a predetermined amount, said controller, after said predetermined period of time has run, restarts heat pump water heater operation and maintains the hot water at the reduced setpoint.

14. The electronic control system of claim 13, wherein upon subsequent high pressure fault occurrences said controller, after each such high pressure fault occurrence, disables heat pump water heater operation for said predetermined period of time and further reduces said hot water setpoint said predetermined amount, said controller, after said predetermined period of time has run, restarts heat pump water heater operation for maintaining the hot water at the further reduced setpoint.

15. The electronic control system of claim 14, wherein upon said hot water setpoint being reduced to a predetermined minimum value, said controller discontinues heat pump water heater operation.

16. The electronic control system of claim 1, wherein the hot water retention tank is incorporated in the heat pump water heater and the condenser is disposed in the hot water retention tank.

17. The electronic control system of claim 1, further comprising a means for circulating a heat source through the evaporator.

18. The electronic control system of claim 17, wherein said heat source circulating means is remotely located and said controller generates a remote output signal for energizing said remote heat source circulating means.

19. The electronic control system of claim 17, further comprising a refrigerant temperature sensing means for sensing the temperature of the refrigerant flowing from the evaporator and into the suction side of the compressor, said refrigerant temperature sensing means generating a refrigerant temperature output signal representative of such temperature, said controller receiving said refrigerant temperature output signal and upon detecting an excessive suction side refrigerant temperature disabling the heat source circulating means.

20. The electronic control system of claim 19, wherein said controller, upon the suction side refrigerant temperature falling to a predetermined low limit setpoint, enabling the heat source circulating means.

21. The electronic control system of claim 17 further comprising a freeze protection sensor for sensing the temperature of compressed refrigerant entering the evaporator and generating compressed refrigerant output signal representative of the temperature of the refrigerant entering the evaporator, said controller receiving said compressed refrigerant output signal and, upon detecting a freeze condition at the evaporator according to a preset low limit temperature setpoint, disabling heat pump water heater operation for a predetermined period of time.

22. The electronic control system of claim 21, wherein the hot water retention tank includes electric resistance heating elements and said controller energizes the electric resistance heating elements to maintain said hot water setpoint upon the occurrence of a freeze condition.

23. The electronic control system of claim 1, wherein the evaporator is thermodynamically coupled to an air heat source and the heat pump water heater includes a means for circulating the air heat source through the evaporator.

24. The electronic control system of claim 1, wherein the hot water retention tank is an external body of water and said first sensing means senses the temperature of the external body of water, said controller cycling the heat pump water heater and said circulating means to maintain the temperature of the external body of water in accordance with a predefined setpoint.

25. The electronic control system of claim 1, wherein the evaporator is thermodynamically coupled to a condenser of a direct exchange heat source, whereby heat is transferred from the direct exchange heat source to the evaporator.

26. The electronic control system of claim 1, wherein said controller includes memory having at least one of a group of operational programs, said group of operational programs comprising:

liming parameter control, high evaporator temperature control, on peak setback, quick heat recovery mode, demand sampling control, periodic sampling control, fault retry and diagnostics service routine.

27. The electronic control system of claim 26, wherein said liming parameter control consists of the following steps:

monitoring the pressure at a discharge side of the compressor;

detecting excessive discharge pressure and sending a fault signal to said controller;

discontinuing heat pump water heater operation for a predetermined delay period; and reducing said hot water setpoint by a predetermined amount.

28. The electronic control system of claim 27 comprising the further step of repeating the above steps until said hot water setpoint reaches a predetermined minimum value at which point the heat pump water heater operation is terminated.

29. The electronic control system of claim 26, wherein the evaporator is thermodynamically coupled to a heat source and the heat pump water heater includes a means for circulating the heat source, said high evaporator temperature control comprises the following steps: monitoring the temperature of the refrigerant entering a suction side of the compressor; detecting an excessive heat exchange medium temperature as sensed in the preceding step according to a predetermined high limit setpoint; disabling the heat source circulating means upon detecting an excessive suction side refrigerant temperature; enabling the heat source circulating means upon the suction side refrigerant temperature falling to a second predetermined setpoint; and repeating the above steps to maintain suction side heat exchange refrigerant temperature between said second setpoint and said high limit setpoint.

30. The electronic control system of claim 26, wherein said fault retry service routine consists of the following steps: monitoring fault indication signals input to said controller; initiating a fault retry wait period and allowing continued heat pump water heater operations; detecting a sustained fault indication; initiating a second fault retry weight period and allowing continued heat pump water heater operations; and disabling heat pump water heater operation upon detecting a sustained fault indication for a second time.

31. The electronic control system of claim 30 comprising the further step of resetting the fault retry to an initial state upon failing to detect a sustained fault indication.

32. An electronic control system for controlling a heat pump water heater including a compressor, an evaporator, and a condenser coupled with a hot water retention tank to form a hot water circuit, the hot water retention tank including means for receiving water from a supply source and means for discharging heated water, said control system comprising:

first means for sensing the temperature of water in the hot water circuit and generating a first output representative of such temperature;

means for circulating water from the hot water retention tank, through the condenser and back to the hot water retention tank; and a controller for receiving said first output signal and providing periodic sampling control, said controller energizing said circulating means for a first predetermined period of time to sample said first output signal and, upon detecting a call for heat, cycling the heat pump water heater to maintain a predefined hot water setpoint, said controller maintaining the heat pump water heater in a de-energized state for a second predetermined period of time when no demand for hot water is detected.

33. The electronic control system of claim 32 wherein said controller is reset to wait a third predetermined period of time before initiating periodic sampling operation upon the cessation of heat pump water heater operation.

34. An apparatus for heating water comprising: an evaporator in heat exchange relationship with a heat source; a condenser; a compressor operatively disposed between said evaporator and said condenser and having a suction line and a discharge line; a hot water retention tank in heat exchange relationship with said condenser, said hot water retention tank including means for receiving water from a supply and means for discharging heated water; means for circulating water from said hot water retention tank, through said condenser and back to said hot water retention tank; and an electronic control apparatus comprising: first means for sensing the temperature of water stored in said hot water retention tank and generating a first output signal representative of such temperature;

second means for sensing the temperature of the domestic hot water at said discharge means of said hot water retention tank and generating a second output signal representative of such temperature; and a microprocessor-based controller for receiving said first and second signals output, whereby upon detecting a rise in the temperature of the heated water at said discharge means said controller samples said first output signal and cycles said compressor to maintain a predefined hot water setpoint.

35. The water heating apparatus of claim 34 further comprising third means for sensing the temperature of the water supply at said receiving means of said hot water retention tank and generating a third output signal representative of such temperature, whereby upon detecting a drop in the temperature of the water at said receiving means and a rise in temperature of the heated water at said discharge means said controller samples said first output signal and cycles said compressor to maintain a predefined hot water setpoint.

36. The water heating apparatus of claim 34, wherein the hot water retention tank is a stand alone domestic water heater having electric resistance heating elements.

37. The water heating apparatus of claim 34, wherein the hot water retention tank includes electric resistance heating elements, said controller energizes the electric resistance heating elements for added water heating capacity in the event the temperature of the heated water at said discharge means of the hot water retention tank falls below a predetermined low limit temperature setpoint.

38. The water heating apparatus of claim 37, wherein a central control signal enables/disables electric resistance heating element operation.

39. The water heating apparatus of claim 38, wherein said central control signal is initiated by an energy provider via a radio controlled grounded signal.

40. The water heating apparatus of claim 34, wherein a central control signal disables water heating system operation.

41. The water heating apparatus of claim 40, wherein said central control signal is initiated by a central energy provider during periods of peak energy demand.

42. The water heating apparatus of claim 41, wherein upon said central control signal changing state so as to allow water heating system startup, said water heating system implements a random time delay of divergent length during power up.

43. The water heating apparatus of claim 34 further comprising a low pressure switch and a high pressure switch, said low pressure switch disposed in said suction line of said compressor and generating a low pressure output signal representative of a low pressure fault condition in the event refrigerant pressure falls below a preset limit, said high pressure switch disposed in said discharge line of said compressor and generating a high pressure output signal representative of a high pressure fault condition in the event refrigerant pressure exceeds a preset limit, said controller receiving said low pressure and high pressure output signals and disabling water heating system operation in the event of a low pressure fault condition or a high pressure fault condition.

44. The water heating apparatus of claim 34, wherein said heat source is a loop hydronic heat source and said water heating apparatus includes a means for circulating the loop hydronic heat source through said evaporator.

45. The water heating apparatus of claim 34, wherein said heat source is an air heat source and said water heating apparatus includes a means for circulating said air heat source through said evaporator.

46. The water heating apparatus of claim 34 further comprising a freeze protection sensor disposed in said suction line of said compressor, said freeze protection sensor generating a freeze condition output signal representative of a freeze condition, said controller receiving said freeze condition output signal and, according to a preset low limit temperature setpoint, disabling water heating system operation upon detecting a freeze condition.

47. The water heating apparatus of claim 34, wherein said heat source is a condenser of a direct exchange heat source, whereby heat is transferred from the refrigerant of said direct exchange heat source to said evaporator by circulating the refrigerant through said evaporator.

48. A method of controlling a heat pump water heater having a compressor, an evaporator, and a condenser coupled with a hot water retention tank to form a hot water circuit, the hot water retention tank including means for receiving water from a supply and means for discharging heated water, said method comprising the following steps:

sensing the temperature of the water at the receiving means of the hot water retention tank and sensing the temperature of the heated water at the discharge means of the hot water retention tank;

utilizing a microprocessor-based controller to detect a hot water demand based upon a decrease in the temperature of the water at the receiving means of the hot water retention tank in conjunction with an increase in the temperature of the heated water at the discharge means of the hot water retention tank;

upon detecting such hot water demand, causing water to circulate between the hot water retention tank and the condenser; and sensing the temperature of the water in the hot water circuit and cycling the heat pump water heater compressor to maintain the water in the hot water retention tank at a predetermined setpoint.

49. The method of controlling a heat pump water heater of claim 48 wherein the hot water retention tank includes electric resistance heating elements, said control method comprising the further step of energizing the electric resistance heating elements for additional water heating capacity in the event the hot water circuit water temperature or the temperature of the heated water at the discharge means of the hot water retention tank falls below a predetermined low limit.

50. The method of controlling a heat pump water heater of claim 49 comprising the additional step of disabling the electric resistance heating elements according to an external control signal.

51. The method of controlling a heat pump water heater of claim 48 comprising the additional step of disabling heat pump water heater operation during periods of peak energy demand according to a central control signal.

52. The method of controlling a heat pump water heater of claim 48 comprising the additional step of circulating the water in the hot water circuit and sensing the temperature of the water therein if no demand for hot water is sensed after a preset period of time.

53. The method of controlling a heat pump water heater having a compressor, an evaporator, a condenser coupled with a hot water retention tank to form a hot water circuit, and means for circulating the water contained in the hot water circuit, the hot water retention tank including means for receiving water from a supply and means for discharging heated water, said control method comprising the following steps:

energizing the hot water circulating device;

sensing the temperature of the water in the hot water circuit and generating a signal representative of such temperature;

utilizing a microprocessor-based controller to detect a call for water heating according to the hot water circuit temperature sensed and a predetermined setpoint;

upon detecting that no call for water heating exists, said controller de-energizing the hot water circulating device and waiting a predetermined period of time before repeating the above steps;

upon detecting a call for water heating, said controller cycling the heat pump water heater compressor to maintain the predetermined setpoint; and waiting a predetermined period of time and energizing the hot water circulating device.

54. The method of controlling a heat pump water heater of claim 53 wherein the hot water retention tank includes electric resistance heating elements, said control method comprising the further step of energizing the electric resistance heating elements for additional water heating capacity in the event the hot water circuit water temperature or the temperature of the heated water at the discharge means of the retention tank falls below a predetermined low limit.

55. The method of controlling a heat pump water heater of claim 54 comprising the additional step of disabling the electric resistance heating elements according to an external control signal.

56. The method of controlling a heat pump water heater of claim 53 comprising the additional step of disabling heat pump water heater operation during periods of peak energy demand according to an external control signal.

57. A method of monitoring liming conditions for use in controlling a heat pump water heater comprising a compressor, an evaporator, a condenser coupled with a hot water retention tank to form a hot water circuit, and means for circulating the water contained in the hot water circuit, the hot water retention tank including means for receiving water from a supply and means for discharging hot water, a high pressure switch disposed in a discharge line of the compressor and generating a first output signal representative of a high pressure fault condition, and a controller for receiving said first output signal, said liming control method comprising the following steps:

disabling heat pump water heater operation for a first predetermined period of time and reducing a hot water setpoint a first predetermined amount upon said controller receiving said first output signal;

restarting heat pump water heater operation after said first predetermined period of time has run and maintaining the hot water temperature according to the reduced setpoint;

disabling heat pump water heater operation a second predetermined period of time and further reducing said hot water setpoint by a second predetermined amount upon subsequent high pressure fault occurrences; and restarting heat pump water heater operation after said second predetermined period of time has run and maintaining the hot water at the further reduced setpoint.

58. The method of monitoring liming conditions of claim 57, wherein upon said hot water setpoint reaching a predetermined minimum value, said controller discontinues heat pump water heater operation.

* * * * *